United States Patent [19]

Bayha

[11] Patent Number: 4,821,024

[45] Date of Patent: Apr. 11, 1989

[54] DOOR OPERATOR PRE-WARNING SYSTEM

[76] Inventor: Allan T. Bayha, 2704 Soper Hill Rd., Everett, Wash. 98205

[21] Appl. No.: 80,434

[22] Filed: Aug. 3, 1987

[51] Int. Cl.[4] ..... G08B 21/00

[52] U.S. Cl. ..... 340/545; 49/30; 49/507; 340/309.15; 340/527; 340/540

[58] Field of Search ..... 340/540, 545, 679, 825.36, 340/309.15, 527, 528; 49/30, 58, 506, 507

[56] References Cited

U.S. PATENT DOCUMENTS

| | | | |
|---|---|---|---|
| 3,247,615 | 4/1966 | Kalog | 49/30 |
| 3,783,556 | 1/1974 | Cook | 49/25 |
| 3,874,117 | 4/1975 | Boehm | 49/264 |
| 4,167,833 | 9/1979 | Farina et al. | 49/199 |
| 4,186,521 | 2/1980 | Hunter | 49/30 |
| 4,197,675 | 4/1980 | Kelly | 49/31 |
| 4,266,221 | 5/1981 | Hawkins | 340/679 |
| 4,426,639 | 1/1984 | Jessup | 49/30 |

*Primary Examiner*—Glen R. Swann, III

*Attorney, Agent, or Firm*—Allan T. Bayha

[57] ABSTRACT

An advance warning system for an automatic electric door operator in which a command signal originating from a remotely located hand held radio transmitter or a wall switch located within the garage is received and processed by a signal receiver and transmitted to a signal delay unit. Upon receipt of the command signal, the delay unit activates a warning light and warning horn to alert persons in the vicinity of the door or operator mechanism that the operator is about to be activated. After a predetermined delay period, the delay unit also generates an operating signal which activates the operator.

2 Claims, 2 Drawing Sheets

DOOR OPERATOR PRE-WARNING SYSTEM

BACKGROUND OF THE INVENTION

This invention generally relates to automatic electrically powered door operators, and more particularly to an advance warning system for such operators which will alert persons in the vicinity of the door or the operator mechanism that operation of the door is eminent.

As the use of automatic electric door operators has increased in the past few years, so have the number of injuries caused by these devices. While they are not inherently unsafe, they are like many other machines and power tools in that they may be operated in an unsafe way. Of particular concern from a safety standpoint is the type of electric door operator which can be actuated from a location remote from the door with an electromagnetic or sonic transmitter such as a common garage door opener. One problem with these particular operators is that persons may and often do actuate them when they are not in a position to observe the doors. As a result, persons in the proximity of the door or the operator mechanism may be endangered.

Injuries and damages have also occurred when such doors have been actuated by spurious or "phantom" signals from passing aircraft, other sources of electromagnetic radiation, and even accidentally transmitted commands. In connection with such incidents, people have been struck by the doors, crushed under the doors or caught in the operator mechanisms. There have also been incidents wherein small children have been strangled by ropes attached to the doors for use in manual operation.

Presently known electric door operators do not include any means to provide advance warning to persons nearby that operation of the door is imminent. The only safety device commonly used with the operators is a door reversing mechanism which senses the amount of resistance to movement encountered by the door and reverses the motion of the door when the resistance reaches a certain predetermined level. These mechanisms are not adequate to prevent many of the above mentioned injuries or damages and will not necessarily prevent serious injuries to small children. Also, their effectiveness can be reduced or eliminated if they are not properly adjusted.

Accordingly, it is a principal object of this invention to provide for an advance warning system for automatic electric door operators which will warn persons in the proximity of the door or the operator mechanism that operation of the door is imminent. Another object of this invention is to provide an advance warning system which can be easily adapted to existing automatic electric door operators without significantly increasing their cost.

A further object of this invention is to provide an advance warning system for automatic electric door operators including a warning light and an audible signal which can be recognized and responded to even by a small child.

SUMMARY OF THE INVENTION

This invention can be broadly summarized as providing for an advance warning system for automatic electric door operators which includes means for generating a command signal, means responsive to that command signal for producing an operating signal which is delayed from the command signal by a predetermined period of time, and means also responsive to the command signal for emitting a warning that operation of the door is imminent.

In accordance with more detailed aspects of the invention, the means for generating a command signal may include a radio transmitter and receiver or a manually operated switch. Also, the means for emitting the warning signal may include a warning light, an audible signal, or both.

Finally, the invention can also be described as an automatic electric door operating system which includes means for generating a command signal, means responsive to the command signal for producing a delayed operating signal, means also responsive to the command signal for emitting a warning signal and means responsive to the operating signal for actuating the door.

DESCRIPTION OF THE PREFERRED EMBODIMENTS

The novel features believed to be characteristic of this invention are set forth in the appended claims. This invention itself, however, may be best understood and its various objects and advantages best appreciated by reference to the detailed description below in connection with the accompanying drawings.

Figure 1:
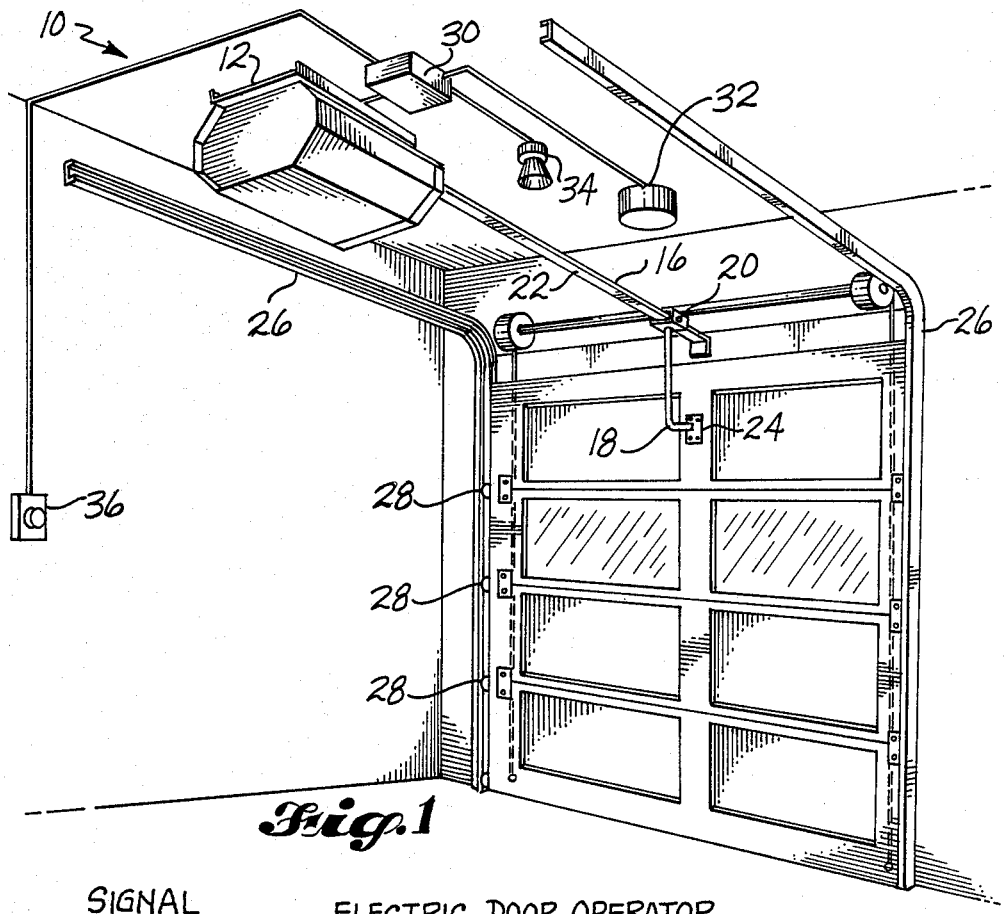
FIG. 1 is a perspective view of a typical automatic electric door operator installation in which the operator has been modified to include the subject invention.

FIG. 1 illustrates an automatic electric door operator system 10 including an advance warning system installed in a typical residential garage. The system includes housing 12 which encloses, among other things, an operator drive assembly, a signal receiver, and a drive sprocket assembly. The drive assembly is connected to door 14 by drive chain 16 and arm 18 which slidably mounted at its upper end 20 to track 22 and pivotally mounted at its lower end 24 to the door. Door 14 is mounted for translation to tracks 26 by a plurality of roller assemblies of which roller assembly 28 is typical. Manual control switch 36 is mounted to the wall of the garage, preferably near an entrance to the garage, and is electrically connected to signal delay unit 30. These components and their mechanical relationship are common to many door operators in use and are well known to those skilled in the art.

Figure 2:
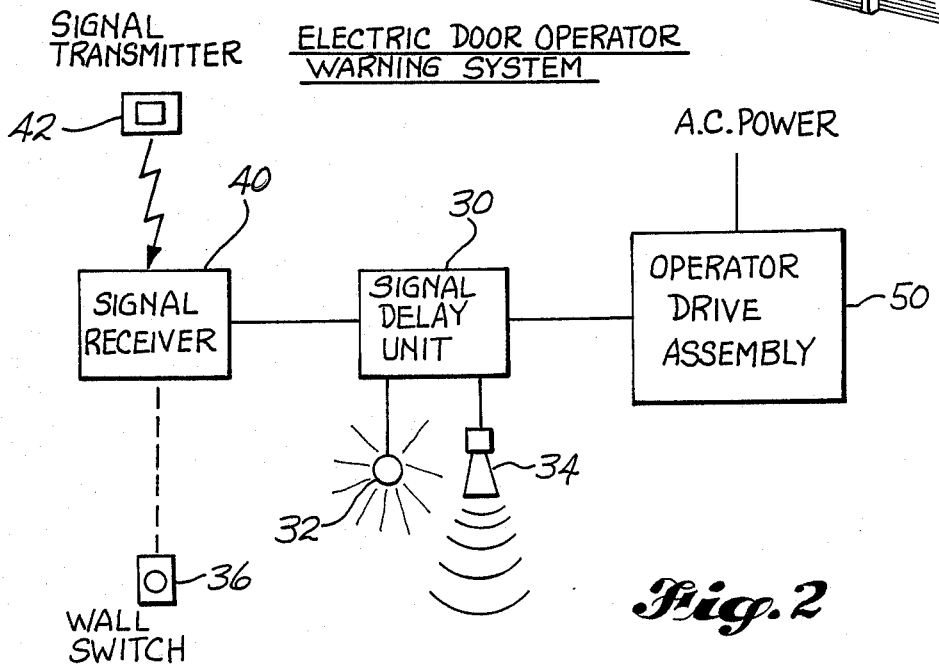
FIG. 2 is a block diagram of the operator of FIG. 1, including two alternate command signal sources.

Mounted on the ceiling near housing 12 is signal delay unit 30 which is electrically connected to the signal receiving unit in the housing and also to warning light 32 and warning horn 34. Preferably the warning light and horn are mounted to the ceiling of the garage in the vicinity of door 14. The functional relationship between the signal receiver, signal delay unit 30 and the operator drive assembly is shown in the schematic diagram of FIG. 2.

Figure 3:
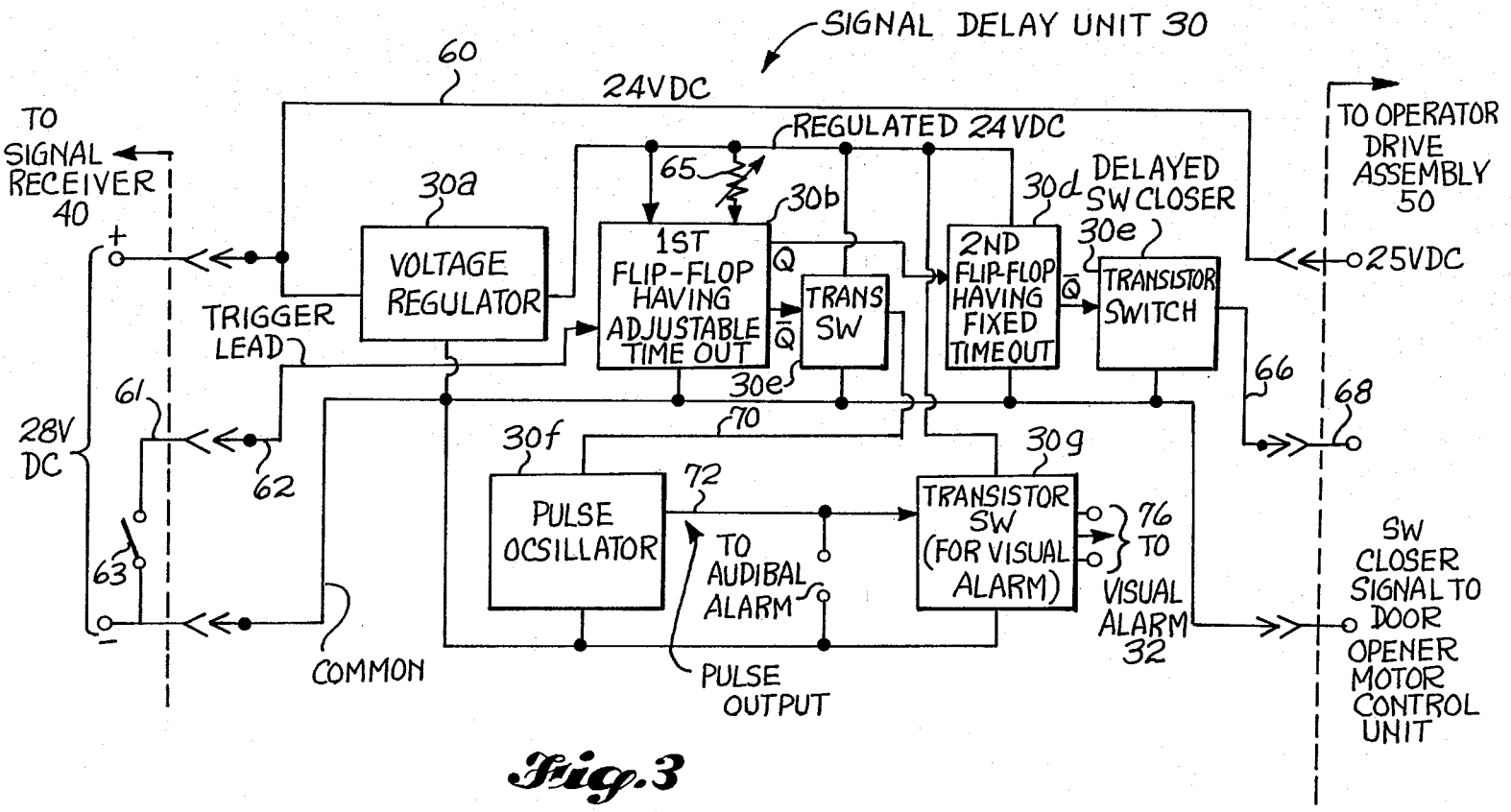
FIG. 3 is a block diagram of a signal delay unit, a component of the operator of FIG. 1.

From that figure it can be seen that a command signal is transmitted either from wall switch 36 or signal transmitter 42 to signal receiver 40. Preferably the signal transmitter is a compact, portable battery powered radio transmitter designed to be carried in a vehicle. It is capable of transmitting an electromagnetic signal of sufficient strength to be detected by the signal receiver over a distance of a few hundred yards. As is well known to those skilled in the art, the electromagnetic signal is coded to minimize the possibility of actuation of the system by spurious or phantom electromagnetic signal or another transmitter not matched to the receiver. The command signal, whether originating from the transmitter or the wall switch, is then transmitted by the signal receiver to the signal delay unit, activating a trigger pulse shift circuit within the unit. The purpose of the circuit, which is described in greater detail in FIG. 3, is to activate warning light 32 and warning horn 34 and, after a predetermined delay period, produce an operating signal to activate operator drive assembly 50. The length of the delay period is chosen to provide sufficient time for a person in the vicinity of the door or the operator mechanism to move to a safe location before operation of the door begins.

Referring to the schematic diagram in FIG. 3, signal delay unit 30 is here provided by circuit components including: voltage regulator 30*a*, a first monostable multivibrator or flip-flop 30*b* for receiving a trigger pulse from signal receiver 40, a transistor switch 30*c* connected to the output of flip-flop 30*b*, another monostable multivibrator or flip-flop 30*d* also connected to a different output of the first flip-flop 30*b*, an output transistor switch 30*e*, a pulse oscillator 30*f* for driving the audible and visual alarms and a transistor switch 30*g* for energizing the visual alarm 32 in response to oscillator 30*f*.

Power for the circuitry of unit 30 is supplied from operator drive assembly 50 via a lead 60 carrying 24 volts dc. Voltage regulator 30*a* regulates this dc power and supplies regulated 24 volt dc to each of flip-flops 30*b* and 30*d* as well as to transistor switch 30*c* and transistor switch 30*g*. The other circuit components including transistor switch 30*e* and pulse oscillator 30*f* are powered indirectly from the regulated 24 volt dc source through flip-flop 30*d* and transistor switch 30*c*, respectively. Flip-flop 30*b* is connected over lead 62 to receive the trigger signal from terminal 61 of signal receiver 40. This trigger or command signal normally causes immediate operation of drive assembly 50 to open the door. Terminal 61 of signal receiver 40 is connected through a switch 63 of receiver 40 that closes in response to either a remote control command signal transmitted to the receiver, or a direct command signal from the wall switch 36. In either event, lead 62 receives a signal in the form of the closing of switch 63 to initiate the operation of delay unit 30.

Here the trigger signal applied over lead 62 is coupled to an input of the first flip-flop 30*b*, which is a monostable multivibrator having an adjustable timeout. In response to the trigger signal received via lead 62, flip-flop 30*b* switches state causing its Q output to assume a high logic value and the $\overline{Q}$ output to switch to a low level logic. This switched state continues for a time period that is adjustable by means of variable resistance 65 connected to flip-flop 30*b*. The resulting timeout period corresponds to the desired delay interval. The switched state of flip-flop 30*b* causes two separate but related responses in the remaining circuit components.

The Q output of flip-flop of 30*b* is applied to the second flip-flop 30*d* in a well known manner so as to cause the second flip-flop 30*d* be triggered at the end of the timeout period of the first flip-flop 30*b*. This is accomplished by connecting the Q output of flip-flop 30*b* over lead 64 to an input of the second flip-flop 30*d* which is responsive to a low-going signal transition corresponding to the Q output's switching from high level to low level logic at the end of the delay interval. Hence, the state of second flip-flop 30*d* is switched at the end of the delay interval and at that time the $\overline{Q}$ output thereof changes logic level to operate transistor switch 30*e*. Flip-flop 30*d* is also a monostable multivibrator device having a fixed timeout period such that the $\overline{Q}$ output changes its logic level for a predetermined pulse width interval. This pulse of predetermined width thus causes transistor switch 30*e* to generate a time shifted or delayed operating (switch closure) signal at output 66 for application to an input terminal 68 of operator drive assembly 50. The leading edge of this operating signal is shifted in time (delayed) relative to the leading edge of the initiating switch closure signal on lead 62 by the duration of the adjustable timeout period of the first flip-flop 30*b*.

The other circuit action initiated by the switching of flip-flop 30*b* occurs by reason of transistor switch 30*c* responding to the switched state of the $\overline{Q}$ bar output of flip-flop 30*b* to energize pulse oscillator 30*f* via lead 70. This response occurs without significant delay, substantially at the time that the trigger signal on lead 62 causes flip-flop 30*b* to change state. Thus upon receipt of the initiating trigger signal on lead 62, pulse oscillator 30*f* is energized and begins outputting a series of pulses over output lead 72. The duty cycle of the pulse output from oscillator 30*f* is selected for activating the visual and audible alarms 32 and 34 at a frequency that has the desired alarm perception. Audible alarm 34 is connected across terminals 74 at the output lead 72 from pulse oscillator 30*f*, and a transistor switch 30*g* converts the pulse output on lead 72 into a suitable switching signal at output leads 76 across which the visual alarm 32 is connected.

It will be appreciated by those of ordinary skill that the circuit of FIG. 3 is only one of a number of circuits designs that could be employed to produce a delayed operating signal and actuate the warning devices. This particular circuit is shown for purposes of illustration only.

Thus it can be seen that the present invention provides for an improved automatic electric door operating system which incorporates many novel features and offers significant advantages over the prior art. Although only one embodiment of this invention has been illustrated and described, it is to be understood that obvious modifications can be made of it without departing from the true scope and spirit of the invention.

I claim:

1. An automatic electric door operator including an advance warning system, the door operator comprising:

a door operator assembly for moving an overhead door between an open and a closed position, said assembly including electrically operated power means responsive to an operating signal;

means responsive to a remotely generated command signal for producing the operating signal delayed from the command signal by a predetermined period of time including (i) a first monostable flip-fop means having a predetermined timeout period and being connected to receive the command signal for switching state after the predetermined timeout period as measured from the receipt of the command signal, (ii) a second monostable flip-flop means connected to the first monostable flip-flop means for producing a pulse of predetermined time width in response to a switch in the state of the first monostable flip-flop, and, (iii) a transistor switch means connected to the second monostable flip-flop means for producing the operating signal in response to the pulse of predetermined time width and, means also responsive to the command signal for emitting a warning a signal to indicate that movement of the door from either position is imminent.

2. An automatic electric door operator including an advance warning system, the door operator comprising:

a door operator assembly for moving an overhead door between an open and a closed position, said assembly including an electric motor responsive to an operating signal and means for interconnecting the door and the motor;

means responsive to a remotely generated electromagnetic command signal for producing the operating signal delayed from the command signal by a predetermined period of time, the means for producing including a time delay unit having:

a first monostable flip-flop means having a predetermined timeout period and being connected to receive the command signal for switching state after the predetermined timeout period as measured from receipt of the command period, a second monostable flip-flop means connected to the first monostable flip-flop means for producing a pulse of predetermined time width in response to a switch in the state of the first monostable flip-flop, and, a transistor switch means connected to the second monostable flip-flop means for producing the operating signal in response to the pulse of predetermined time width, means also responsive to the command signal for emitting a warning signal to indicate that movement of the door from either position is imminent, the warning signal including a warning light and an audible signal; and, a portable transmitter for generating the command signal.

* * * * *